US006589106B1

(12) United States Patent
Balmelle

(10) Patent No.: US 6,589,106 B1
(45) Date of Patent: Jul. 8, 2003

(54) CONSUMABLE POLISHING ELEMENT, PARTICULARLY FOR FINISHING OPTICAL GLASS

(75) Inventor: Alain Balmelle, Corderon (FR)

(73) Assignee: Etablissements D Curt, Societe Anonyme, La Rochelle (FR)

( * ) Notice: Subject to any disclaimer, the term of this patent is extended or adjusted under 35 U.S.C. 154(b) by 0 days.

(21) Appl. No.: 09/584,664

(22) Filed: Jun. 1, 2000

Related U.S. Application Data

(60) Provisional application No. 60/043,405, filed on Apr. 4, 1997.

(30) Foreign Application Priority Data

Jun. 1, 1999 (FR) ..... 99 07035

(51) Int. Cl.[7] ..... B24B 1/00

(52) U.S. Cl. ..... 451/526; 451/532; 451/536; 51/295; 51/307

(58) Field of Search ..... 451/526–527, 451/528, 530, 531, 532–533, 536; 51/295, 307

(56) References Cited

U.S. PATENT DOCUMENTS

| | | | | | |
|---|---|---|---|---|---|
| 4,576,612 | A | | 3/1986 | Shukla et al. | |
| 5,437,700 | A | * | 8/1995 | Duquesne | 51/295 |
| 5,626,512 | A | * | 5/1997 | Palaikis et al. | 451/536 |
| 5,712,210 | A | * | 1/1998 | Windisch et al. | 442/320 |
| 5,816,902 | A | * | 10/1998 | Watanabe et al. | 451/532 |
| 5,858,140 | A | * | 1/1999 | Berger et al. | 451/539 |
| 6,243,934 | B1 | * | 6/2001 | Wadzinski | 451/296 |

FOREIGN PATENT DOCUMENTS

| | | |
|---|---|---|
| WO | WO 98/45112 | 10/1998 |
| WO | WO 99/10569 | 3/1999 |

* cited by examiner

*Primary Examiner*—Eileen P. Morgan
(74) *Attorney, Agent, or Firm*—Young & Thompson

(57) ABSTRACT

A polishing element for mineral or organic optical glass, adapted to be mounted on a rotatable support, of a shape suitable for that of the glass to be polished, includes a base constituted by a polymeric film, of a woven or non-woven fabric, having, at its surface, a flocking of fibers of viscose and or polyamide fixed on the base by glue, the fibers having a length between 0.3 mm and 1.0 mm.

14 Claims, 1 Drawing Sheet

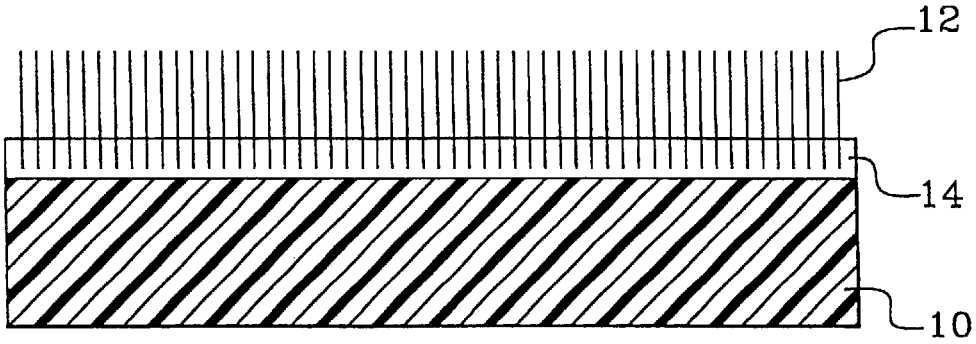
FIGURE

CONSUMABLE POLISHING ELEMENT, PARTICULARLY FOR FINISHING OPTICAL GLASS

BACKGROUND OF THE INVENTION

The present invention relates to a consumable polishing element for finishing optical glass.

Description of the Related Art

Thus, optical glass is subjected to several trans-formation steps to arrive at the desired geometrical form and the final transparency.

The surfacing of optical glass, on the concave or convex surface, comprises at least three major steps:

rough grinding which gives the overall profile, fine grinding which smooths the surface, and polishing which further refines the surface and gives the glass its transparency.

Given the diversity of the profiles of optical glass, there have been provided specific supports, called "pads" which are removably mounted on rigid rotating supports, called "tools" and which are used as consumable items to carry out operations of fine grinding and polishing.

These pads are generally fixed by an adhesive interface directly on the tool, or else driven by a material of very high coefficient of friction, itself fixed to an adhesive interface on the tool.

The glass is at present, for the most part, organic glass and the problems which arise are not necessarily in the technology of production of the shapes but rather in production times so as, on the one hand, to produce the required production within the shortest delay possible, and on the other hand, to decrease the cost.

It is accordingly necessary to find arrangements of material constituting the pads, which will permit gains in polishing time, which use less costly materials because they are consumable elements, which can adapt to the conditions of fine grinding.

There is known from French patent application 2.595.606 a multi-layer abrasive disc having two populations of calibrated abrasive grains. Thus, the disc comprises two layers, an internal one near the support, and the other one external and opposite the support. In the external layer, there are included grains of a size greater than those of the grains disposed in the internal layer, and this in a ratio of about 1.5 to give an order of magnitude.

It is thus possible to rough grind in a first phase and then to refine with smaller grains, under a water spray.

Preferably, such arrangements use abrasive grains included in a polymeric support of the type hardenable under ultraviolet light.

It is known that in such an embodiment, there are abrasive grains which are maintained in a polymeric support.

There exists another technique which consists in using pads in the form of discs of fibrous material which are sprayed, during the working period, with liquids including abrasive particles. These discs must have particular shapes so as to match as closely as possible the shape of the tool, and so as best to retain the liquid which lubricates and carries the abrasive particles, whilst limiting the wear of said fibers which could lead to deterioration of the quality of polishing and/or pollution of the bath.

SUMMARY OF THE INVENTION

The present invention relates to a consumable polishing element of the pad type which is economical, which permits great saving of time, which permits achieving a suitable polishing quality, which can be mass-produced, which can receive liquids with suspension of abrasives of known type, with a lifetime compatible with the parameters of polishing and which is simple to use.

To this end, according to the invention, the finishing polishing element for mineral or organic optical glass, adapted to be mounted on a rotating support, of a form suitable to that of the glass to be polished, comprising a base constituted by a polymeric film, a woven or non-woven fabric, is characterized in that it comprises at its surface a flocking comprising fibers of viscose and/or polyamide fixed on said base by means of a cement, said fibers having a length comprising between 0.3 mm and 1.0 mm, more particularly 0.5 mm.

As to the diameter of the fibers, it is comprised between 5 $\mu$m and 25 $\mu$m and preferably between 15 $\mu$m and 25 $\mu$m.

The base and the retained cement also have specific characteristics for optimum results.

BRIEF DESCRIPTION OF THE DRAWINGS

The present invention will now be described with respect to the drawing in which the single FIGURE shows in schematic cross-sectional view an element of the pad type.

DESCRIPTION OF THE PREFERRED EMBODIMENTS

In this single FIGURE, there is shown a base 10 which is cut from a polymeric film. This base could also be cut from a woven or non-woven fabric, according to the applications, but the best results have been obtained with a polymeric base.

There will also be noted another advantage, which is related to tearing off, due to the fact that the polymeric film can easily support the traction without having an isotropy and tearing as with fabrics, which renders the fabrics fragile when the operation exerts a traction to ensure removable of the pad from the tool.

According to a preferred embodiment, the polymer is a vinyl polychloride. The specific mass is comprised between 150 g/m$^2$ and 400 g/m$^2$, preferably 240 g/m$^2$, which corresponds to a thickness substantially 0.25 mm.

The density of the support has a strong influence on numerous working parameters and gives certain advantages.

Thus, the density permits good configuration on the tool, a good gripping during emplacement and removal of the pad, good resistance to compression and homogeneous distribution of the pressure during work, which is synonymous with a high precision of polishing.

This base is preferably cut in the shape of a disc because the machines which receive it are of the rotary type. The term disc must be taken in its broadest sense, which is to say a figure of revolution, but it can of course take a circular form or oval form, with leaves or not, with indentations or not.

This base 10 is then flocked by distributing fibers 12 in an adhesive 14. The fibers are disposed in excess and are oriented by known processes in this technical field, such as the creation of electrostatic fields.

Preferably, the fibers are viscose fibers having a linear density of 5 decitex and a length comprised between 0.3 mm and 1.0 mm, preferably 0.5 mm, which gives a surface mass comprised between 50 g/m$^2$ and 120 g/m$^2$, preferably 70 gm$^2$. The length is the length of the fibers as produced and is measured a prior.

There can also be used polyamide fibers, the parameters changing as a result but respecting the same final parameters.

The diameter of these fibers is comprised between 5 and 25 $\mu$m and preferably between 15 and 25 $\mu$m, for given lengths.

As to the adhesive, it is preferably a vinyl polychloride base cement with an added plastifier having a surface mass comprised between 50 g/m$^2$ and 150 g/m$^2$, preferably 130 g/m$^2$.

To give an order of magnitude, the total thickness of the polishing element according to the invention is comprised between 0.8 and 0.90 mm, more particularly 0.85 mm.

Thus designed, the polishing element according to the present invention permits obtaining surprising results because the time is reduced from 12 minutes to 7 or 8 minutes for a same surface of same shape and using a same polishing liquid with aluminum oxide.

Furthermore as to time saving, it is also noted that 80% of the work of polishing is carried out between 1 and 2 minutes whilst the known pads do not permit detecting the beginning of polishing during this same period.

There is therefore not only an overall saving of time, but also a saving of production.

Test conditions:

glass-treated: organic glass of optical index 1.6; curvature 4.12×4.62;

polishing liquid: aluminum oxide with a particle diameter of 1.3 $\mu$;

polishing pressure: 1.725 bar;

polishing time: 6 minutes.

There has been measured an increase in the removable material at the center of the glass of 16%, under the same conditions, relative to a commercial pad having the same diameter and same shape but whose lengths and diameters of fibers in particular are different.

What is claimed is:

1. A glass polishing pad, comprising:

a flexible base having a disc shape and made of polymeric film of vinyl polychloride with a specific mass between 150 g/m$^2$ and 400 g/m$^2$;

an adhesive layer applied on a planar surface of the base; and flocked fibers of an equal length between 0.3 mm and 1.0 mm mounted orthogonally to the planar surface of the base by the adhesive layer.

2. The glass polishing pad of claim 1, wherein the fibers are viscose fibers having a linear density of 5 decitex.

3. The glass polishing pad of claim 2, wherein the fibers have a surface mass of 70 g/m$^2$.

4. The glass polishing pad of claim 1, wherein the fibers are polyamide fibers having a diameter between 15 $\mu$m and 25 $\mu$m.

5. The glass polishing pad of claim 1, wherein the adhesive is a vinyl polychloride base cement with a plastifier having a surface mass between 50 g/m$^2$ and 150 g/m$^2$.

6. The glass polishing pad of claim 5, wherein a total thickness of the base, adhesive, and flocked fibers is between 0.8 mm and 0.9 mm.

7. Polishing element for mineral or organic optical glass, comprising:

a base comprising a polymeric film having a surface mass between 150 g/m$^2$ and 400 g/m$^2$; and a flocking comprising fibers of viscose or of polyamide fixed on a surface of said base by a glue, the glue having a surface mass between 50 and 150 g/m$^2$, said fibers having a length between 0.3 mm and 1.0 mm.

8. Polishing element according to claim 7, wherein the base is made of polyvinyl chloride.

9. Polishing element according to claim 7, wherein the glue is polyvinyl chloride.

10. Polishing element according to claim 7, wherein the diameter of the fibers is between 5 $\mu$m and 25 $\mu$m.

11. Polishing element according to claim 7, wherein the base is in the form of a disc of a thickness between 0.8 and 0.9 mm.

12. Polishing element according to claim 7, wherein the base is in the form of a disc having leaves.

13. Polishing element according to claim 7, wherein said flocking comprise viscose and polyamide fibers.

14. Polishing element according to claim 7, wherein said fibers have a surface mass between 50 g/m$^2$ and 120 g/m$^2$.

* * * * *